United States Patent [19]

Ishikura et al.

[11] Patent Number: 4,776,282

[45] Date of Patent: Oct. 11, 1988

[54] SELF-RUNNING DEVICE FOR A TRANSPORTING CARRIER

[75] Inventors: Takashi Ishikura, Fukuzaki; Joji Mino; Takaaki Nagato, both of Himeji, all of Japan

[73] Assignee: Tsubakimoto Chain Company, Osaka, Japan

[21] Appl. No.: 24,057

[22] Filed: Mar. 10, 1987

[51] Int. Cl.[4] ..... B61F 9/00; B60M 1/04; C01B 19/00

[52] U.S. Cl. ..... 104/109; 104/139; 104/246; 105/101; 191/30

[58] Field of Search ..... 104/106, 107, 109, 111, 104/118, 139, 140, 141, 142, 143, 144, 145, 146, 119, 246; 191/30, 35; 238/379, 380; 180/6.2; 105/101

[56] References Cited

U.S. PATENT DOCUMENTS

| | | | |
|---|---|---|---|
| 2,632,404 | 3/1953 | Woolery | 105/101 |
| 4,207,821 | 6/1980 | Beckert | 104/106 X |
| 4,375,193 | 3/1983 | Sullivan | 104/118 |
| 4,480,157 | 10/1984 | Ishikura et al. | 191/34 |

FOREIGN PATENT DOCUMENTS

| | | | |
|---|---|---|---|
| 368629 | 2/1939 | Italy | 191/30 |
| 59-186756 | 10/1984 | Japan . | |
| 61-24362 | 2/1986 | Japan . | |
| 2175555 | 12/1986 | United Kingdom . | |

*Primary Examiner*—Robert B. Reeves
*Assistant Examiner*—Frank H. Williams, Jr.
*Attorney, Agent, or Firm*—Dann, Dorfman, Herrell and Skillman

[57] ABSTRACT

A conveyor device for conveying articles along a predetermined path of travel having a running rail on opposite sides of the path of travel. A bus bar is below said running rails. A self-propelled carrier has driving wheels to roll on the running rails. The wheels are rotated by a single electric motor which receives power from the bus bar. Cover members overhang the running rails and wheels during operation, and interlock with the rail support member so that the cover may be readily removed by disengaging the interlock.

11 Claims, 4 Drawing Sheets

SELF-RUNNING DEVICE FOR A TRANSPORTING CARRIER

FIELD OF THE INVENTION

The present invention relates to a conveyor for transporting articles along the floor and is directed specifically to self-propelled carriers which run on rails adjacent the floor level. The present invention is particularly suitable for automobile assembly lines.

BACKGROUND OF THE INVENTION

A conveyor system using self-propelled carriers has advantages over conveyors in which the carriers are advanced by chains which travel along parallel to the rails, particularly in that the propelling means is compact and the conveyor system is simplified.

Conventional self-propelled carriers are disclosed, for example, in Japanese Laid-Open Patent Application No. 186756/1984 and Japanese Laid-Open Utility Model Application No. 24362/1986. In Application No. 186756/1984, running rails are provided by skirt-like support members suspended in opposed spaced relation from both sides of a support stand projecting upwardly from the floor. The carrier rides over the support members and has depending skirt portions embracing the outer sides of the support members and at the bottom of the skirt portions have means extending inwardly and mounting wheels which roll on the running rails. The propelling device is mounted between the running rails and has shoes or other collectors adapted to ride on a bus bar extending between the running rails. The bus bars are therefore enclosed between the running rails and are covered by the supporting members for the running rails, and the collector which engages the bus bars is also covered by these elements and also the upper part of the carrier. This not only results in inconvenience in maintenance of the drive means but also the presence of the support stands in the space between the rails requires that one running rail be mounted on an axle separate from the axle mounting the wheel which supports the carrier on the other running rail. Since the axles for the right and left wheels are on opposite sides of the carrier, only one axle may be driven by the propelling device and the other wheel or wheels are rotated by the travel of the carrier on the rail. Since the carrier is driven on one of the rails and not the other, a torsional moment is applied to the carrier which may impede the running of the carrier on the rails. Furthermore, since the running rails are mounted on the inside of the lower end of the rail support members which are suspended in a skirt-like fashion, an inward bending moment due to the load of the carrier is applied to the rail support members which requires strengthening of the mounting construction of the support members and which renders adjustment of the spacing between the rails difficult.

In Application No. 24362/1986, the running rails are mounted on the top of the support stands, but the disclosed apparatus drives the carrier by means of a single wheel engaged on one of the tracks, the carrier having guide rollers engageable with the other of the tracks for positioning purposes. Therefore, the device of this application is subject to the same deficiency with respect to torsional moment as the device of Application No. 186756/1984. Furthermore, the arrangement of the carrier on the running rails of Application No. 24362/1986, exposes the running surfaces of the rails except when the carrier travels over them and covers them. As a result, foreign matter may adhere to and accumulate on the running surfaces which may cause slippage of the drive wheel on the rail during propusion of the carrier, rendering positive driving of the carrier difficult. Thus, when the carrier is used in an assembly line for automobiles, the assembling work may be inconveniently delayed.

Furthermore, the rails are mounted on sides of the support stands to enable the running wheel and an anti-float roller to engage on the top and bottom respectively of the rail, there is a further disadvantage in restricting the adjustment of the spacing between the rails, as in the previously mentioned U/M application.

If the running rails are made of channel members, and the wheels are arranged to ride on the lower flange, the upper flange protects the running surface from dropping and adhesion thereon of foreign matter, dust or the like. However, when the rails are along a curved path, or the rails must include a switch or change in direction, the travel of the wheels becomes irregular or else the switching arrangement unduly complicates the construction of the rail. Therefore, it is the practice to cause the wheels to travel on the upwardly-facing surface of the running rail.

It has been suggested that cover elements may be provided which overlie the running surfaces of the rail, but such cover elements provide an obstacle to the installation of the conveyor, both in mounting the conveyor in the factory and in assembling the carriers with the conveyor. Accordingly, the cover elements must be removed during installation and reinstalled, entailing substantial additional labor.

With the foregoing in mind, it is clear that the prior art self-propelled conveyors for conveying articles do not permit the use of a common drive axle for wheels on opposite rails and render the adjustment of the rail spacing difficult. Where the carrier running system is enclosed, the maintenance of the system is difficult and when it is exposed, the likelihood of slippage renders the system unsatisfactory.

SUMMARY OF THE INVENTION

A primary object of the present invention is to provide apparatus in which left and right wheels of a carrier are mounted on a common axle which may be driven to positively transport even heavy articles. In this manner, a uniform driving force is applied to both sides of the carrier, thereby allowing the carrier to run on the rails safely without producing a torsional moment.

A further object of the present invention is to provide covering for the running surfaces of the rails which may be easily detached to facilitate maintenance of the carrier running system and carrier driving system.

More specifically, the present invention provides a conveyor device for conveying articles along a predetermined path of travel in which a pair of rail supporting members, each having a running rail mounted on the upper part thereof, are upstanding on opposite sides of the path of travel in spaced apart relation. A structural member having bus bar means thereon is provided between the supporting members, preferably below said running rails. A self-propelled carrier is mounted to run on the rails and has an axle with driving wheels adapted to roll on the running surfaces of the running rails. The wheels are mounted on a common axle which is rotated by the propelling means which receives power from the bus bar through a collector on the carrier. Cover members are detachably mounted on the rail supporting members to overhang the running rails during operation, are are readily removable for maintenance purposes. The cover members provide a free space extending upwardly above the structural member to accommodate the carrier and a supporting member for the articles being conveyed.

The detachable mounting of the cover members is provided by a downwardly-facing recess which may fit over an upwardly-projecting edge on the rail support members and a terminal part having an outwardly-facing latching lip which may interlock with an inwardly-facing latching lip in an upwardly-directed recess of the rail support member so that the cover may be readily removed by disengaging the interlock and removing the cover elements.

BRIEF DESCRIPTION OF THE DRAWINGS

The invention is described in greater detail in connection with the accompanying drawings, wherein.

DESCRIPTION OF THE PREFERRED EMBODIMENT

In the operation of the present invention, a motor supplied with power by a collector in sliding contact with a bus bar is operative to rotatably drive a common axle having driving wheels on the opposite ends thereof which are adapted to roll at uniform speeds on a pair of running rails disposed parallel to each other, so as to be self-propelling.

The running rails for the wheels are disposed near the upper end of support members positioned on opposite sides of the path of travel of the conveyor. In the present instance, the running rails are formed integrally on the inwardly-directed surface of the rail supporting members and the supporting members are mounted on stanchions or frames positioned on the floor of the plant along the path of travel of the conveyor. The mounting of the rail supporting members on the frames affords adjustment of the spacing between the running rails and cover plates are mounted on the outwardly-directed surfaces of the rail supporting members and extend upwardly and inwardly over the running rails to protect the running surfaces from the adhesion and accumulation of foreign matter thereon. The cover plates are readily detachable to facilitate maintenance.

The detachable mounting of the cover plates includes a downwardly-directed recess on the inwardly-directed surface of each cover member which engages over an upwardly-projecting edge on the rail supporting member along the outer limit of the running surface of the running rail. Below the recess, each cover member terminates in a terminal portion having an outwardly-directed latching lip therealong. The terminal portion is adapted to fit into an upwardly-directed recess on the outer surface of the rail supporting member and this recess has an inwardly-directed latching lip to interlock with the outwardly-directed latching lip of the cover element. The cover element extends upwardly from the terminal lip past the running rail and extends inwardly over the running rail at a distance above the running rail to an extent that the center of gravity of the cover plate is positioned inwardly from the recess to produce a rotating moment around the recess which urges the latching lip of the cover element outwardly at its lower end into firm engagement with the latching lip of the upwardly-directed recess. Detachment of the cover member is effected by counter rotating the cover element to disengage the latching lip and thereafter raising the cover member to disengage the edge from the downwardly-directed recess and to disengage the terminal part of the cover member from the upwardly-facing recess.

The interlocking of the latching lips prevents inadvertent disengagement of the cover element from the rail support member so that the cover is normally maintained in position overlying the running surfaces.

Figure 1:
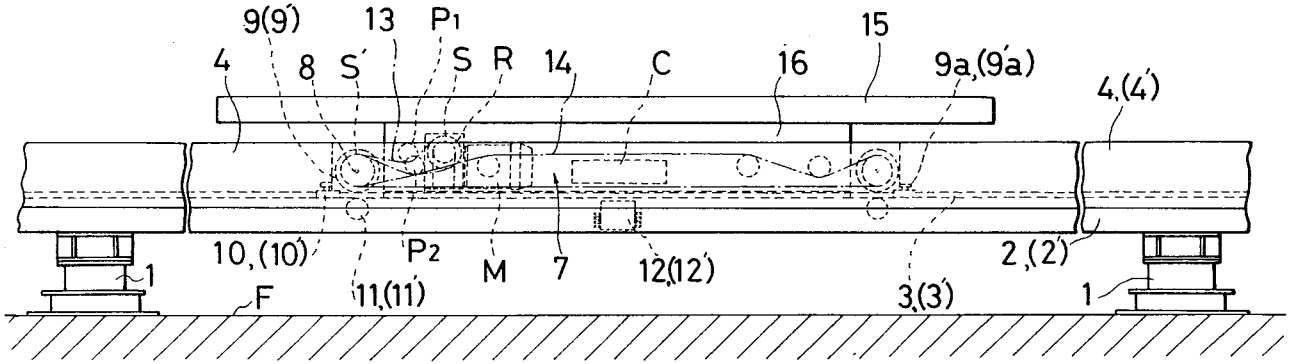
FIG. 1 is a side view of a part of a conveyor system embodying the present invention.
Figure 2:
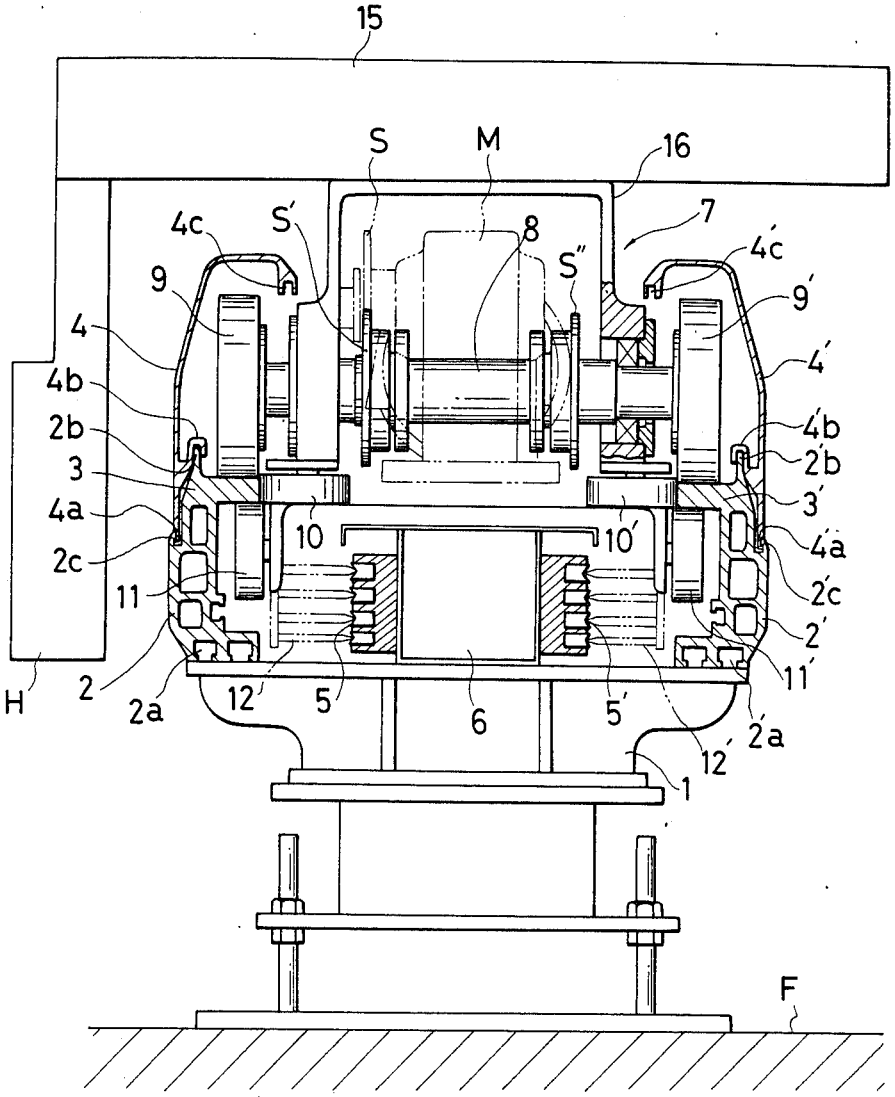
FIG. 2 is a transverse sectional view as seen from the left in FIG. 1.

With reference to FIGS. 1 and 2, the rail supporting members 2, 2' are mounted on the frames 1 which stand upright on the floor surface F. As described hereinafter, the supporting members 2, 2' may be adjusted on the frames 1 to permit adjustment of the free space between the rails. Rail supporting members 2, 2' extend upwardly and are provided with inwardly-directed running rails 3, 3' on opposite sides of the free space between the members. In the present instance, the running rails 3, 3' are formed integrally with the supporting members 2, 2'. Cover plates 4, 4' are detachably mounted on the outwadly-directed surfaces of the supporting members 2, 2' and extend upwardly and inwardly so as to overlie the upper surfaces of the running rails 3, 3' as shown in FIG. 2.

A duct-shaped structural member 6 is disposed in the free space between the rail supporting members 2, 2' and has conductive strips 5 positioned at different levels on the upright side walls of the member. A shield is mounted on the upper surface of the member to overhang the side walls and protect the strips 5. The structural member 6 is hollow so as to accommodate conduits, power cables, controlling cables, etc.

FIG. 2 illustrates the carrier 7 which travels in the free space between the running rails 3, 3'. The carrier 7 has driving wheels 9, 9' mounted on the opposite ends of a common driving axle 8 and these wheels roll on the running rails 3, 3'. In addition, the carrier includes guide rollers 10, 10' mounted on vertical axes to confront the inwardly-directed edges of the running rails 3, 3' to assist in the lateral positioning of the carrier 7 within the free space between the rails. Anti-float rollers 11, 11' are rotatably mounted parallel to the wheels 9, 9' to engage under the running rails 3, 3' and limit the upward displacement of the carrier away from the rails. As shown in broken lines in FIG. 2 and also in FIG. 1, the carrier 7 has collectors 12, 12' mounted on the lower surface thereof, each collector including fingers or wipers adapted to slide along the conductive strips 5, 5' which form the bus bar for transmitting power to the carrier.

The carrier 7 is powered with a propelling device, in the present instance a motor M actuated by receiving a supply of power from the collectors 12, 12' through a controller C for controlling the running speed of the carrier. As shown in FIG. 2, the carrier also has a control panel H mounted at one side thereof which may have manual override controls, i.e emergency stop, start, etc., and may also have (not shown) sensors at its front and rear ends to control the running speed and prevent collision during travel of the carrier through its path of travel through the plant.

In the present instance, the motor M rotatably drives the common driving axle by means of a sprocket S on the motor cooperating through a drive chain 13 with a sprocket S' on the axle. As shown in FIG. 1, the sprocket S of the motor is mounted on the output side of a reduction gear box R. In the illustrated embodiment, the carrier extends a substantial distance along the path of travel and to assure effective driving of the carrier, a second drive axle is provided at the opposite end of the carrier to mount drive wheels 9*a* and 9'*a*. The rear axle is driven through a chain 14 from a second sprocket S" on the front axle 8. A tension pulley P1 is provided for the chain 13 and a pulley P2 is provided for the chain 14.

As shown in FIG. 1, the controller C and collectors 12, 12' are positioned approximately midway between the ends of the carrier 7 and a support member 16 extends upwardly through the free space between the upper terminal ends of the covers 4, 4' to support a transporting bed 15 for the articles being conveyed, for example automotive bodies.

As noted before, the rail supporting members 2, 2' are mounted on the frames 1 by means of bolts (not shown) to afford adjustment of the spacing between the running rails 3, 3'. The under surface of the supporting members 2, 2' have dovetail grooves 2*a*, 2'*a* which may receive the rectangular head of the mounting bolts. The bolts are mounted in holes on both sides of the frame and the head has a short side which may pass into the dovetail groove and a long side which when the bolt is rotated through 90°, engages in the enlarged part of the groove so that when the bolts are tightened by nuts, the supporting members 2, 2' are secured under the frame. By selecting the desired dovetail groove, the spacing between the rails 3, 3' may be adjusted. A fine adjustment may be provided by providing elongated slots for the bolts in the frame 1, although it is contemplated that the rails will be adjusted in increments corresponding to the differing standard gauges between the wheels of the carrier.

Figure 3:
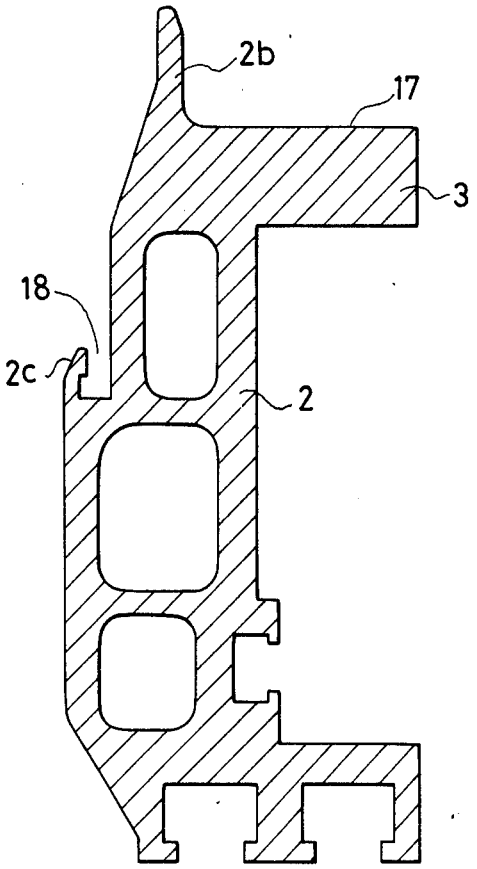
FIG. 3 is an enlarged sectional view through the rail supporting member of FIG. 2.

FIG. 3 illustrates the lefthand rail supporting member 2 in enlarged detail. As shown, the upwardly-projecting support edge at the outward edge of the running rail 3, is shown at 2*b* and the running surface of the rail 3 is indicated at 17. The upwardly-facing recess for the lower terminal portion of the cover member is shown at 18 and the inwardly-directed latching lip is shown at 2*c*.

Figure 4:
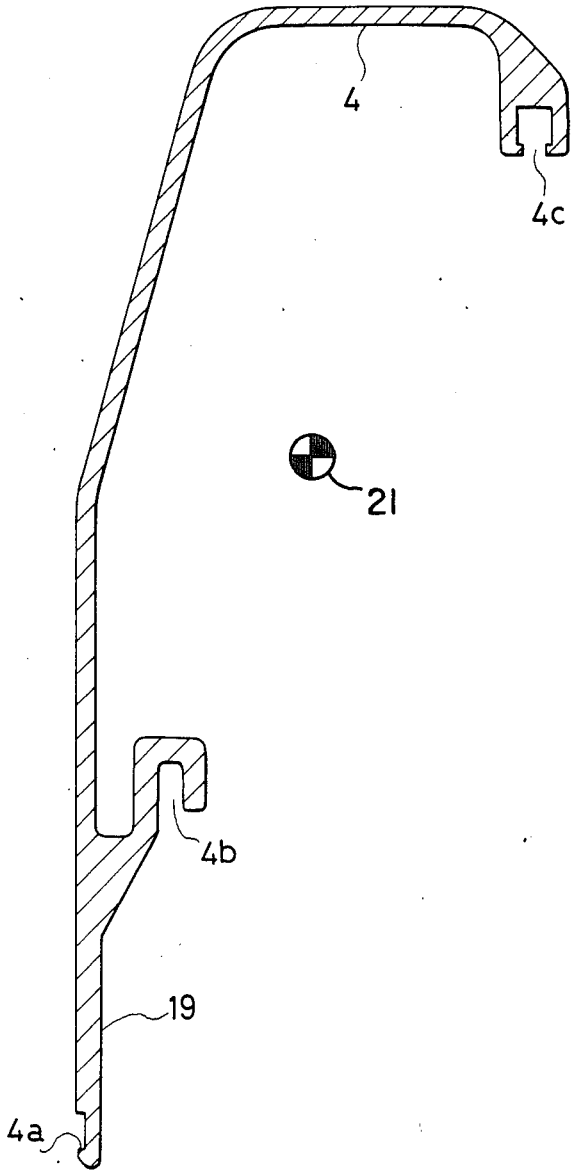
FIG. 4 is an enlarged sectional view of a cover member of FIG. 2.

The configuration of the cover member 4 is shown in enlarged detail in FIG. 4 and the downwardly-facing recess to engage on the edge 2*b* is illustrated at 4*b*. The lower terminal part of the cover member is shown at 19 and the outwardly-facing latching lip is shown at 4*a*. Comparing FIGS. 3 and 4, it is noted that the enlarged part ofthe latching lip 4*a* is no wider than the narrowest part of the upwardly-facing recess 18 so that the terminal part 19 of the cover member 4 may be readily engaged and disengaged in the recess 18.

Installation of the cover member 4 on the rail is accomplished by downward displacement of the cover member to engage the edge 2*b* in the recess 4*b* and to insert the terminal part 19 into the recess 18. The center of gravity of the cover plates is spaced inward from the recess 4*b* and edge 2*b*. When fully engaged, the weight of the cover plate member at its center of gravity tends to rotate the cover member 4 clockwise on the edge 2*b* to interlock the latching lips 4*a* and 2*c*. The interlock avoids inadvertent dislodgment of the cover plate from the support member 3 and thereby maintains the running surface 17 protected from foreign matter falling therein. Although detachable, the cover plaes are latched into position by gravity by the latching lips 4*a* and 2*c* at the lower end of the cover member. This interlock may be readily released by counterrotation of the cover member, and the cover member may be easily removed by simple upward displacement.

As shown, when properly mounted, the cover plate extends upwardly and bends inwardly so as to cover the upper portion of the rail running surface 17. At the inner end, the cover plate 4 is provided with an engaging groove 4*c* which may be used to mount stop members, sensors, limit switches, etc. for controlling the running of the carrier.

The present arrangement of structure shown in the drawings provides the ability to enable a carrier to run on the upwardly-facing surfaces of the running rails with equal drive from the right and left wheels because of their being mounted on a common driving axle. Furthermore, the arrangement enables similar driving force to the wheels at the rear end of the carrier, avoiding torsional moment of the carrier due to limiting the drive to one wheel or to one rail. Thus, the carrier may transport heavy articles without any substantial problem.

Since the bus bars are mounted on the structural member between the rail supporting members on the frames, the power cable for the bus bars and controlling cable or other connecting lines or conduits may all be accommodated within the hollow body structure to make the electrical equipment compact and readily serviceable. Furthermore, since the cover plates are detachably mounted on the supports, the running surfaces of the running rails and the tread surfaces of the wheels are protected when the cover members are installed, resulting in smooth rolling and driving.

The ready removal of the cover members faciliates maintenance of the running system and the driving system and the design is such as to permit mounting and dismounting of the cover members without use of special tools and without need for providing bolt holes or the like for mounting the cover members.

While a particular embodiment of the present invention has been illustrated and described, changes and modifications may be made therein and thereto within the scope of the following claims.

We claim:

1. A self-propelled device for a transporting carrier for conveying articles along a predetermined path of travel, a pair of upright rail supporting members extending along opposite sides of the path of travel, each member having a running rail at the upper part thereof, said running rails being parallel and having upwardly-facing running surfaces with a free space therebetween extending upwardly beyond the running surfaces, a bus bar extending along the length of said path of travel parallel to said running rails, a carrier having a driving axle transverse to said running rails mounted for rotation about its centerline, wheels drivingly secured to the opposite ends of said axle positioned to register with and travel upon said upwardly-facing running surfaces, a collector mounted on said carrier to engage and run in contact with said bus bar as said wheels travel on said running surfaces of said running rails, a propelling device on said carrier adapted to be energizd by said collector so as to rotate said driving axle and wheels, thereby driving said carrier along said running rails, support means projecting upwardly from said carrier in said free space so as to provide support for the article to be conveyed along said path, and a pair of cover members for covering over said running rails and wheels mounted on said rail supporting members outside of said running rails beyond the opposite ends of said axle, extending upwardly past said running rails, and extending inwardly over said rails and wheels and terminating in spaced relation to each other on opposite sidies of said free space so as to afford passage of said support means through said free space.

2. A device according to claim 1 including guide rollers on said carrier mounted to rotate on vertical axes in the free space between said running rails to engage the inner edges of said running rails and maintain said wheels on said running surfaces thereof.

3. A device according to claim 1 including anti-float rollers mounted on said carrier for rotation parallel to said wheels to engage under said running rails and limit upward displacement of said carrier.

4. A device according to claim 1 wherein said carrier extends a given distance along the path of travel, said axle being at one end of the carrier, said carrier having a second axle at the opposite end thereof, said axles being interconnected with each other so as to be driven concurrently by said propelling device, said second axle having wheels secured to the opposite ends thereof positioned to register with and travel upon said running surfaces and thereby assist in driving said carrier, said collector being mounted on said carrier approximately midway between said axles.

5. A device according to claim 4 wherein said propelling device comprises a rotary motor having a drive sprocket and chain connecting said motor to said axle, and a controller connected between said collector and said motor to regulate the speed of said motor and thereby the rate of travel of said carrier on said running rails.

6. A device according to claim 1 including a hollow structural member extending along the path between said upright rail supporting members, said bus bar being mounted on said structural member, the hollow of said structural member being of a size to receive electrical cables for said bus bar.

7. A device according to claim 6 wherein said bus bar comprises a plurality of conductive strips positioned at different levels on upright side walls of said structural member, said member including a shield overhanging said upright side walls to protect against inadvertent contacts with said strips.

8. A device according to claim 1 wherein each of said cover members has a downwardly-directed recess, and a downwardly-extending terminal position having a latching lip facing outwardly therefrom, said rail supporting members each having an upwardly-projecting support edge outwardly from said running rail adapted to engage in said recess to support a cover member, and an upwardly facing recess with an inwardly-directed latching lip to mate and interlock with the latching lip of said downwardly extending terminal portion, so as to releasably latch said cover member in place overlying the running rail.

9. A device according to claim 8 wherein each of said cover members has a center of gravity positioned inwardly from said downwardly-directed recess to urge interlocking of said latching lips by gravity.

10. In self-propelled device for a transporting carrier for conveying articles along a predetermined path of travel having a pair of upright rail supporting members extending along opposite sides of the path of travel, each member having a running rail at the upper part thereof, said running rails being parallel and having upwardly-facing running surfaces with a free space therebetween extending upwardly beyond the running surfaces, said rail supporting members having an upwardly-projecting support edge outwardly from said running rail, and an upwardly-facing recess with an inwardly-directed latching lip, a pair of cover members for covering over said running rails mounted on said rail supporting members outside of said running rails, extending upwardly past said running rails and extending inwardly over said rails and terminating in spaced relation to each other on opposite sides of said free space so as to afford passage through said free space, each of said cover members having a downwardly-directed recess on its inward side to receive the support edge of the rail supporting member, and a downwardly-extending terminal portion having a latching lip facing outwardly therefrom to mate with the latching lip of the upwardly facing recess of the rail supporting members, so as to enable releasable latching of said cover members in place overlying said running rails.

11. A device according to claim 10 wherein each of said cover members has a center of gravity positioned inwardly from said downwardly-directed recess to urge interengagement of said latching lips by gravity.

* * * * *